US005445565A

United States Patent [19]

Setteducati

[11] Patent Number: 5,445,565

[45] Date of Patent: Aug. 29, 1995

[54] TABLE TOP MAGIC THEATER SET

[76] Inventor: Mark Setteducati, 218 E. 17 St., New York City, N.Y. 10003

[21] Appl. No.: 182,935

[22] Filed: Feb. 18, 1994

[51] Int. Cl.[6] ..... A63J 21/00

[52] U.S. Cl. ..... 472/57; 472/75; 472/81

[58] Field of Search ..... 472/57, 75, 81, 84, 472/137, 72, 73; 40/400, 390; 434/429; 312/244; 206/45.13, 45.15

[56] References Cited

U.S. PATENT DOCUMENTS 1,541,925 6/1925 Davidson ..... 472/73
1,762,501 6/1930 Brehmer ..... 472/73 X
1,878,813 9/1932 Block et al. ..... 206/45.15
2,400,982 5/1946 Dobrin ..... 472/57

*Primary Examiner*—Carl D. Friedman
*Assistant Examiner*—Kien T. Nguyen
*Attorney, Agent, or Firm*—Robert W. Usher

[57] ABSTRACT

A magic set comprises a valise containing a set of props, cue sheets and a series of illustrated sheets pivotally bound together. The case can be opened to support the sheets as an elevated, horizontally extending stack to form a stage. Successively uppermost illustrated sheets of scenery can be turned over by a magician to hang vertically from the front of the stage interacting with the illustrated sheet next uppermost to provide different scenes of a continuous magic show. Indicia marked on the illustrated sheets interact and interfit with props in the performance of tricks.

20 Claims, 8 Drawing Sheets

FIG. 1
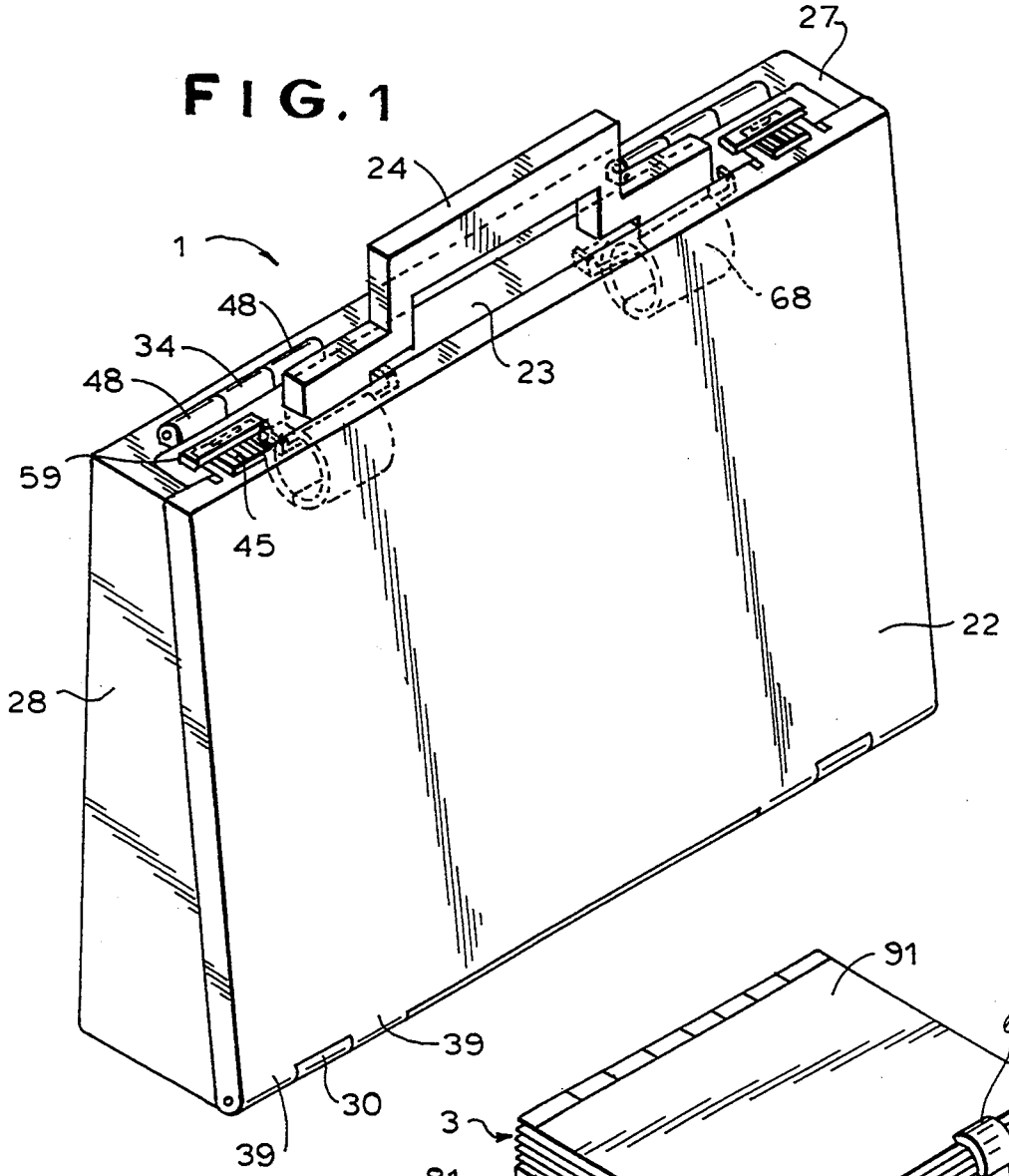
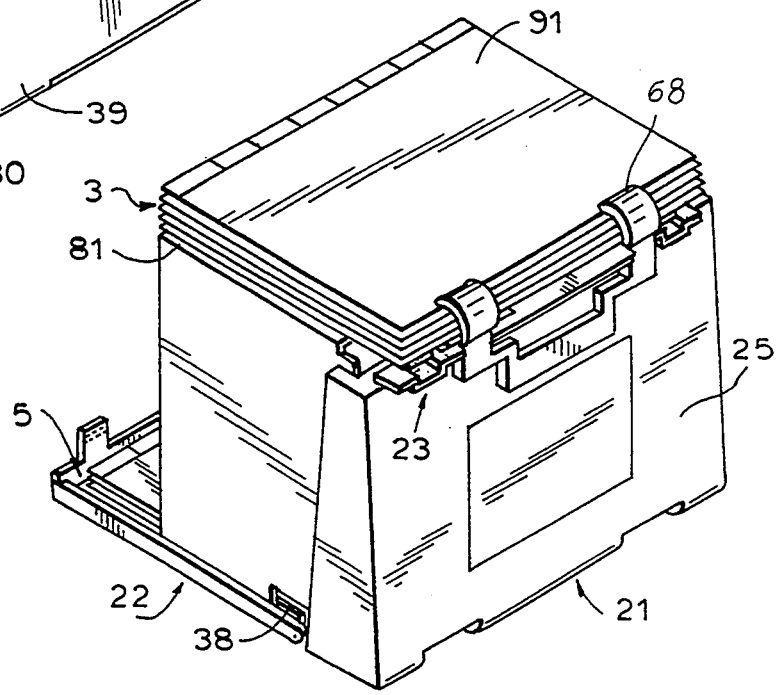
FIG. 6

TABLE TOP MAGIC THEATER SET

FIELD OF THE INVENTION

The invention relates to a magic set and particularly to a table top magic theater set suitable for children or novice magicians for theatrical presentation of a continuous magic show.

BACKGROUND OF THE INVENTION

Known magic sets usually consist of a box containing a plurality of trick elements or props for use in different tricks together with a set of instructions for performing each trick.

However, no provision is made for scenery relating to or interacting with any particular magic trick performed or for scene changes throughout the show resulting in a relatively static and untheatrical presentation without support is then provided for the modest skills of the novice magician in maintaining the interest of the audience.

Additionally, although individual tricks often require careful preparation (e.g. correct juxtapositioning) concealed from the audience for convincing presentation, known sets do not normally effectively facilitate such prior preparation, while the instructions do not normally provide directions or material linking or associating the individual tricks in a predetermined order so as to form a continuous show.

As a result, difficulties in arranging and manipulating the different props and trick elements in an orderly manner during the show impose too great a burden on a novice or child magician so that trick elements and props may easily be mislaid or lines of dialogue forgotten resulting in hesitation and fumbling in full view of an audience with loss of theatrical and magical effect, and consequential discouragement and disappointment, inhibiting the would be magician from further efforts.

An example of a simulated table top stage for performing magic tricks is taught by U.S. Pat. No. Des. 243707 issued to Brass on Mar. 15, 1977. However, no provision is taught, for example, for scenery relating to tricks performed.

SUMMARY OF THE INVENTION

It is an object of the invention to obviate or ameliorate at least some of the above-mentioned disadvantages by providing a magic theater set which facilitates the presentation of tricks in an orderly fashion and, particularly in a predetermined order linking successive tricks to form a continuous magic show.

An additional object of the invention is to provide a different backdrop or scenery for each trick.

Further objects of the invention are to provide sets of instructions and prompts for presentation with each trick which are both concealed from the audience's view and are captive with the set, obviating risk of loss.

Additional objects of the invention are to provide a magic set with a case containing all the components of the set and which can be opened and erected rapidly and easily to form a magician's table top stage.

According to one aspect of the invention, there is provided a magic set comprising a series of props; a series of sheets having faces marked with indicia illustrating ones of scenes and trick elements of a magic show; means supporting the sheets pivotally bound together along one of their corresponding edges as an elevated stack so that the individual outermost sheets can be turned over successively from the stack by a magician to reveal said faces successively to an audience for performance of related tricks in conjunction with selected of the props.

This enables an easy, quick and effective transformation between scenes for successive tricks resetting scenes appropriately for each new trick.

Desirably, indicia on successive sheets interact directly to form one of a trick and continuous story line of the show greatly enhancing the theatrical impact and continuity of the performance.

Preferably, at least some of the sheets have both of their opposite faces marked with the indicia and the supporting means supports the elevated stack with the sheets thereof extending horizontally, forming a table top stage, so that successively outermost sheets can be turned over to extend vertically in front of an audience, indicia of faces of horizontally and vertically extending sheets so revealed, interacting to illustrate ones of scenes and trick elements of a magic show. Indicia on at least some of the sheets may interact to illustrate trick elements of a magic show and props are positioned between selected of the sheets which interact to form the trick elements.

The presentation of scenery extending both horizontally and vertically before an audience enhances the theatrical effect and increases the scope and variety of tricks that may be performed while greatly facilitates the preparation of the tricks, as many of the props can be prepositioned by the magician before the start of the show so that they are ready for use at the appropriate moment in the show. For example, one face of one of the sheets which interact to form a trick element is marked with first indicia forming a trick element and props positioned on said face are marked with second indicia which interact directly with the first indicia in performance of a trick. The elevated horizontally extending stack forming the stage provides a storage area for props and an instruction set enabling manipulation of both concealed from the audience view, while the raised level of the stage facilitates prop handling.

Preferably, predetermined illustrated sheets have tabs which provide finger-engageable portions, outermost of the predetermined illustrated sheets overlying and thereby concealing tabs on predetermined successive sheets permitting a magician to turn over a selected number of sheets together simultaneously without detection by an audience as a function of a trick. Another advantage is that two or more sheets may be simply clipped together to omit a trick that a young magician may not be sufficiently skilled or competent to perform while the continuity of the presentation may be retained.

This also provides increases the element of surprise and provides another magical dimension.

It is also preferred that there are a series of cue sheets having upper faces marked with indicia forming cues pertinent to respective ones of different scenes and trick elements on respective illustrated sheets and means are provided to support the cue sheets extending horizontally as a stack below the stack of illustrated leaves and concealed thereby from the audience with successively uppermost cue sheets being removable by the magician one by one to expose successive upper faces thereof only to the magician thereby presenting cues pertinent to respective ones of different scenes and trick elements on respective illustrated sheets simultaneously with performance of respective tricks.

Thus, the cues or instructions can be correlated with the tricks simultaneously with their performance.

In a preferred construction, the supporting means comprises a case including a front compartment which is open to a rear and comprises a top and an elongate base portion, a front panel and side panels extending between the top and a front, longitudinal edge and opposite end edges of the base, respectively, and an elongate hinge member having a front longitudinal edge portion pivotally connected to the top and carrying adjacent a rear longitudinal edge, binding ring means threaded through respective sheets, whereby the hinge member can be pivoted forwardly from a rear, collapsed, position, in which the stack of sheets is suspended from the binding ring means stored within the front compartment, to an erect, front position, in which the binding ring means extends forward beyond the front panel with the horizontally extending sheets of the stack extending rearward thereof and so that the individual sheets turned over from the stack can hang vertically from the binding ring means in front of the front panel.

This provides advantages in both conveniently compact storage, portability, ease of handling and presentation.

The supporting means may include, a stand comprising a panel form platform having a front edge pivotally mounted on the binding ring means under the stack and having flap form supporting struts hingedly connected to respective opposite side edges thereof so that the stand is movable from a collapsed, vertically extending condition forward of the stack in which the flaps are fold together bout the hinges in flat face-to-face relation against the panel to an erect condition in which the panel together with the flaps and stack is pivoted upward and the flaps are pivotally spread apart under the stack supporting the stack with the sheets extending horizontally.

This affords sturdy and reliable but simple and compact support for the stack of illustrated sheets and which is remarkably simple to erect and which can also be folded away completely within the case when not in use.

The binding ring both secures the illustrated sheets and stand in both collapsed and erect conditions.

In a preferred embodiment, a set of instructions is attached to the supporting means behind the stack whereby they are concealed from an audience's view. More specifically, the set of instructions comprises a series of cue sheets having cue forming indicia on respective faces and means binding the cue sheets together along one of their corresponding edges as a stack so that the individual cue sheets can be turned over successively from the stack by a magician to expose their faces thereby revealing respective cues corresponding to successive of said one of scenes and trick elements. This is facilitated by the cue sheets being formed with tabs correlated with respective illustrated sheets and preferably aligned with tabs provided on the illustrated sheets which also facilitate turning to the correct sheets for interposing props therebetween prior to the presentation of a show.

Preferably, a rear compartment is pivotally connected to the base for movement between an open, horizontally extending position to a closed vertically extending position covering the open rear of the front compartment, latching means being provided to releasably lock the case in the closed condition completely enclosing the props, instruction set and illustrated sheets therein for protection and safekeeping.

As a result of the concealment provided by the case and the ease of erection and prop preparation, the entire magic set can even be erected in front of an audience without destroying the theatrical and surprising magical effects.

According to another aspect of the invention, a magic set comprises a case including a front compartment which is open to a rear and comprises a top and an elongate base wall, a front wall and side walls extending between the top and a front, longitudinal edge and opposite end edges of the base, respectively; and, a rear compartment for movement between a closed condition of the case, in which the rear compartment is in a vertically extending position covering the open rear of the front compartment, and an open position, allowing a magician access thereto, latching means being provided to releasably latch the rear compartment and the front compartment together in the closed condition; a series of props for use in performing tricks; a set of instructions for the tricks; a series of sheets having faces marked with indicia illustrating ones of scenes and trick elements of a magic show; binding ring means mounted at the top of the front compartment and threaded through respective sheets, whereby the set can be transformed from a collapsed, stored condition in which the case is closed by the rear compartment being latched in covering relation to the front compartment with the props, instruction set and the series of sheets contained therein, so that the sheets hang vertically as a stack from the binding ring means, to an erected condition in which the case is open with the rear compartment unlatched therefrom and in which individual outermost sheets can be turned over successively from the stack by a magician to hang in front of the front wall thereby revealing said faces successively to an audience for performance of related tricks in conjunction with selected of the props.

BRIEF DESCRIPTION OF THE DRAWINGS

An embodiment of the invention will now be described by way of example only and with reference to the accompanying drawings in which:

FIG. 1 is a perspective view of the valise in closed condition;

FIG. 6 is a partly schematic, perspective view of the front of the set in fully erected condition ready for performance of a magic show;

DESCRIPTION OF PARTICULAR EMBODIMENT

Figure 2:
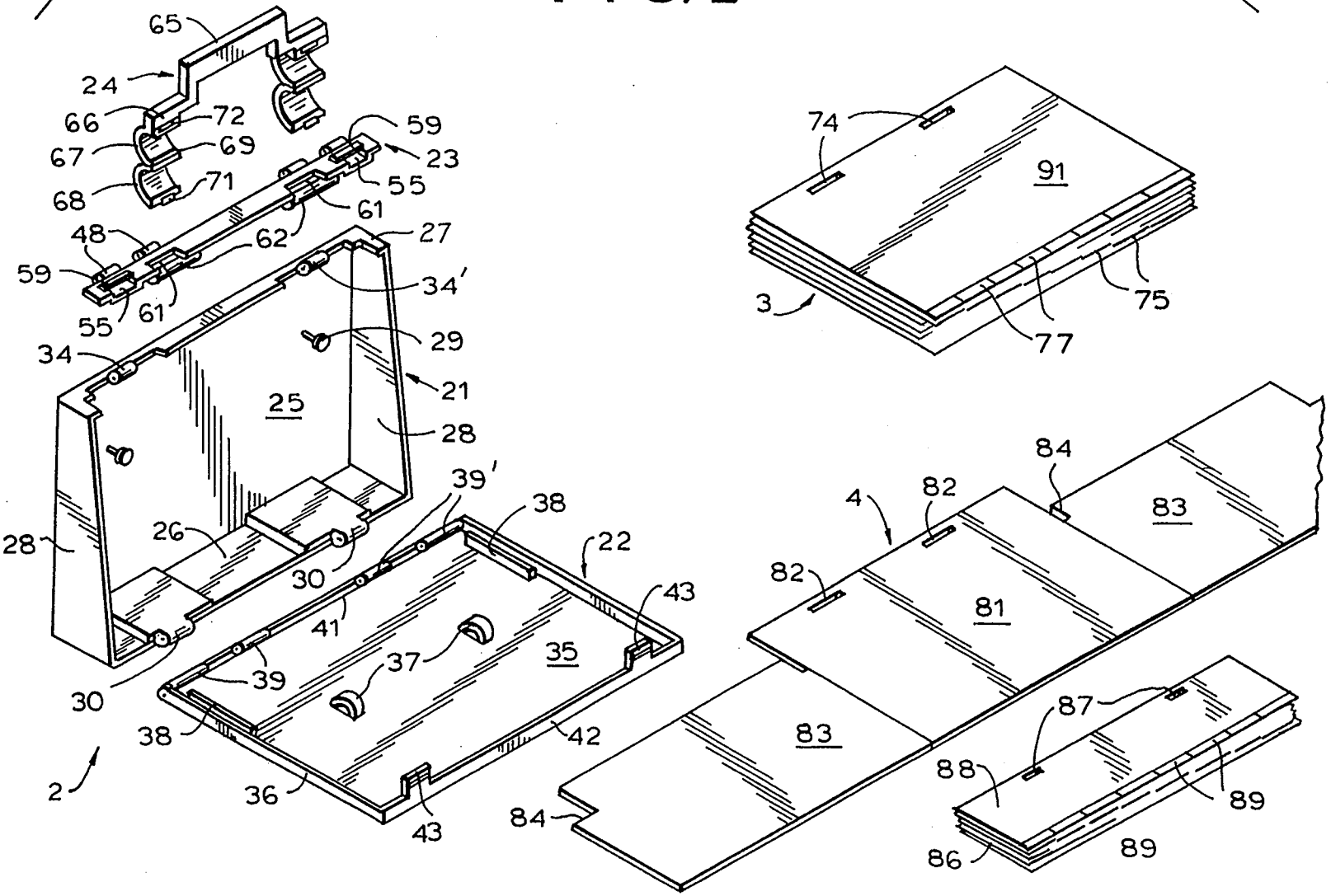
FIG. 2 is an exploded perspective, partly schematic view of the set.
Figure 5:
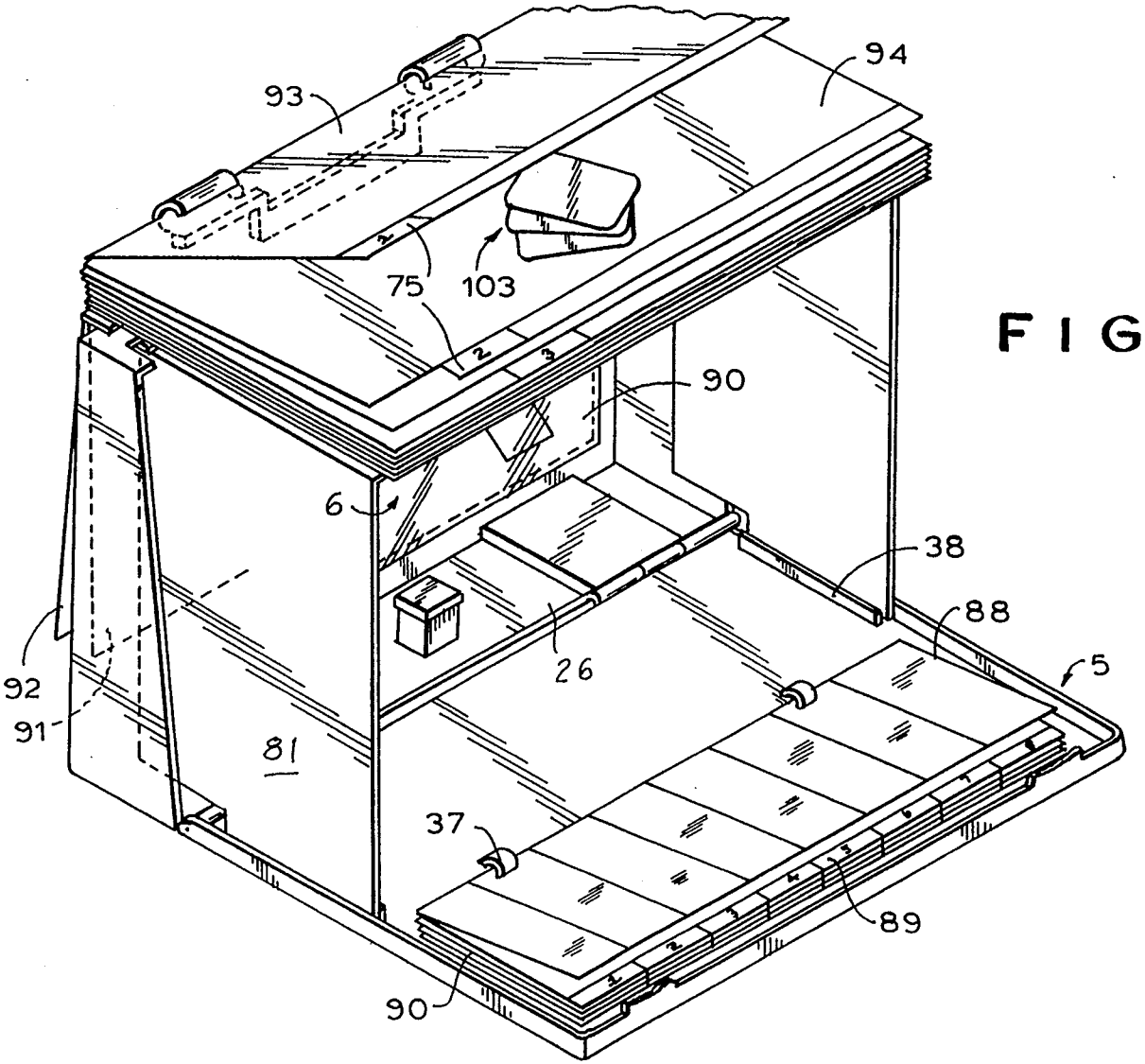
FIG. 5 is a partly schematic, perspective view of the rear of the set in fully erected condition and during performance of a magic show.
Figure 7:
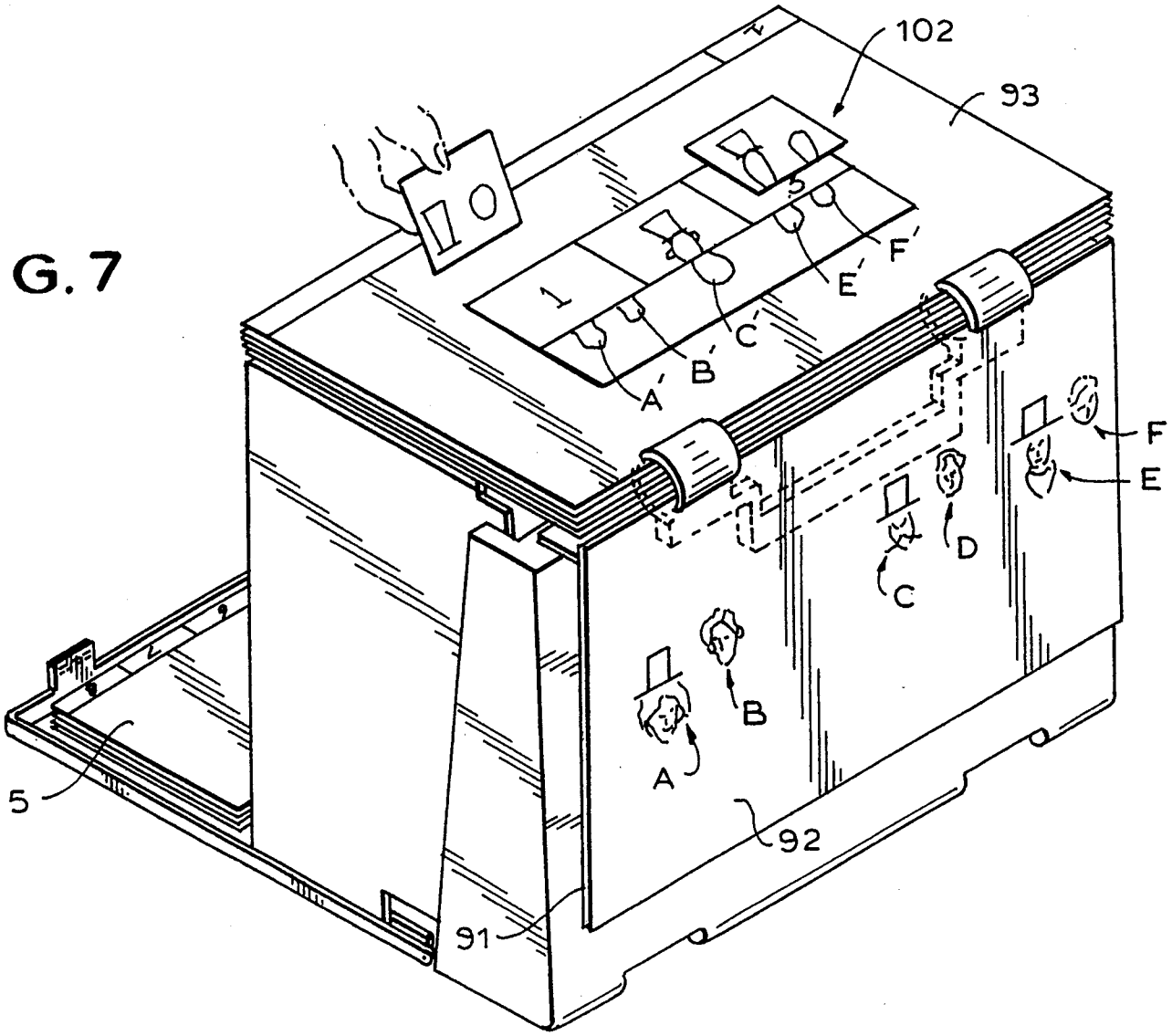
FIG. 7 is a partly schematic, perspective view of the front of the set in fully erected condition and during performance of a magic show; and, FIGS. 8A–8L are schematic, perspective views of the front of the set and props used during successive tricks performed in the show.

As shown particularly in FIGS. 1, 2 and 5, the magic set 1 comprises a valise style case 2 containing a series or stack of illustrated sheets or pages 3; a platform or stage assembly 4; a set of cue-sheets 5; and a set of props 6.

The case 2 consists of four members, each injection molded from plastic material and constituting a front, main compartment 21, a rear compartment or cover 22 pivotally connected thereto, a hinge 23 and, a carrying handle 24 pivotally connected thereto to form a double-hinge assembly.

Figure 4C:
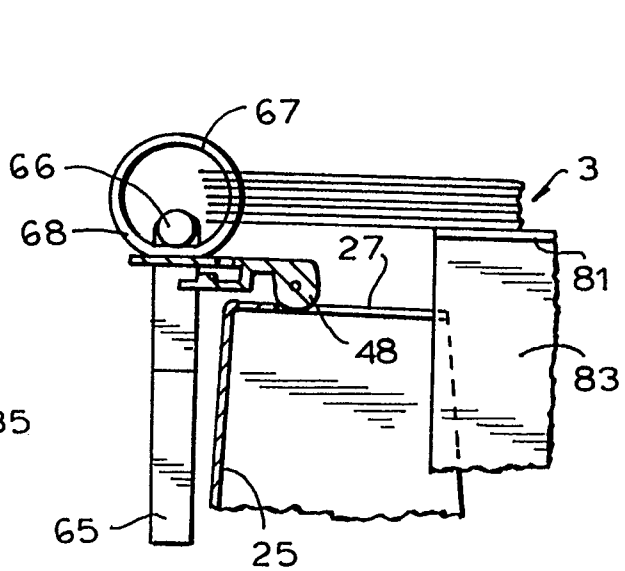
FIGS. 4A, 4B and 4C are fragmentary cross-sectional views taken along lines 4A, 4B and 4C in FIGS. 3A, 3B and 3C, respectively, showing, in particular, successive positions of the hinge member.

The main compartment 21 comprises a rectangular front panel 25 from respective opposite major and minor edges of which extend base and top panels 26 and 27, respectively, and side panels 28, respectively. The front panel 25 is inclined rearward at an acute angle to the base 26 to ensure clearance for sheets turned over from stack 3 and the handle to hang vertically from the top wall, clear of the front of the front panel, as explained below. A pair of hanging pegs 29 for receipt of a prop storage bag 90 (FIG. 4) are formed at spaced apart locations on the inner surface of the front panel. The side panels 28 taper as they extend upwards from the base 23 also for clearance purposes. The rear edge of the base is integrally formed with a pair of hinge pin receiving ears 30. The top panel 27 is rebated along a free, rear edge to accommodate the hinge member 23 as a close fit, and substantially coplanar therewith and formed with a pair of hinge ears 34.

The rear compartment 22 is a tray-like structure, having a main panel 35 with a shallow peripheral lip 36 upstanding therefrom. A pair of internal, arcuate, binding rings 37 are integrally formed internally at spaced-apart locations on a central axis and internal locating ribs 38 extend in parallel relation to portions of the lip on opposite minor edges. Two pairs of hinge ears 39, 39' are formed at spaced apart locations on a portion of the lip extending along a major edge, the ears of each pair being spaced apart for receiving between them respective hinge ears 30 for receipt of a common hinge pin pivotally connecting the front and rear compartments.

Figure 4B:
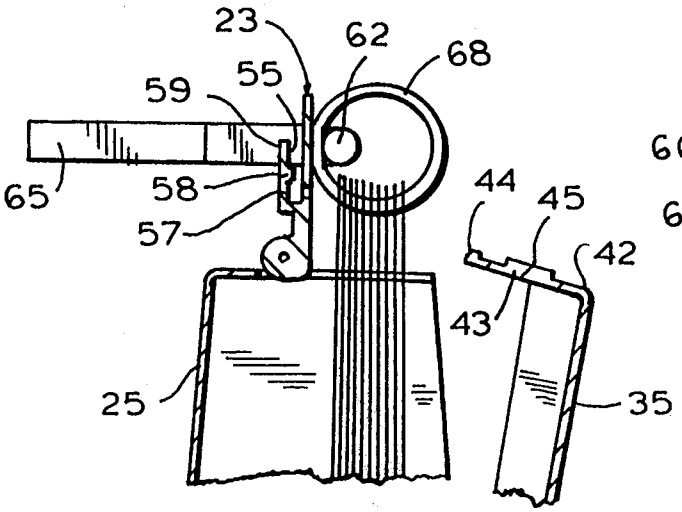
Figure 4A:
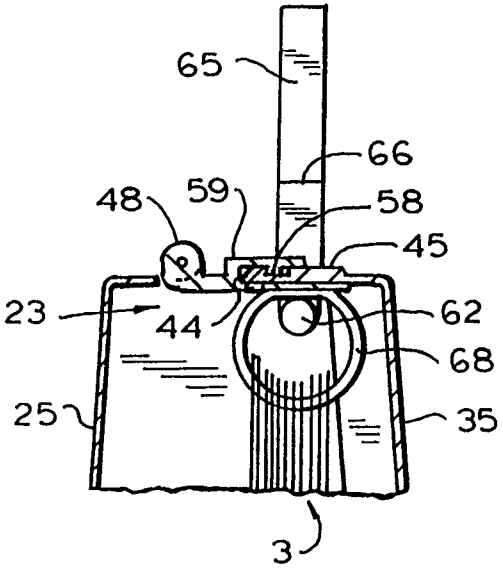

As shown most clearly in FIGS. 4*a*–4*b*, a pair of latching detent tongues 43 outstand from the lip 36 on the opposite major edge 42 and have catches 44 at free ends and outstanding abutment/finger pieces 45 spaced therefrom.

As best seen in FIGS. 2, 4*a*–4*c*, the hinge member 23 is of generally strip-form with two pairs of hinge ears 48, 48' extending upwards from a longitudinal rear edge and interfitting with respective ears 34, 34' for receipt of a common hinge pin, pivotally to connect the hinge member to the top wall 27 of the main compartment 21. Latching channels 55 for receiving the latching tongues 43 extend from a front, free edge of the hinge member at locations adjacent respective opposite ends to latching recesses 57 which are formed behind latching abutments 58 by raised lands 59. Ring hinge receiving eyes 61 are formed aligned over bridging pivot axles 62 at locations adjacent respective latching channels.

The handle 24 comprises an elongate grip 65, from respective opposite ends of which depend mounting lugs 66 carrying living hinges each constituting upper and lower hemi-cylindrical members 67, 68 of a ring binder precursor joined in arcuate-end-to-arcuate-end by a web hinge 69. The uppermost member 67 is rigidly joined tangentially to a lug 66, and the free end of the lower member 68 is formed with a locking protuberance 71 receivable as a force fit in a socket 72 formed in the captive end of the upper ring element thereby securing the ring members together in closed condition forming the ring binder both to pivotally mount the illustrated sheets and to pivotally attach the handle to axles 62.

The sheets 3 carry illustrations of successive scenes or trick elements and some props on respective opposite faces thereof and which are described in greater detail below in relation to FIGS. 7 and 8*a*–8*l*. Mounting slots 74 are formed adjacent first major longitudinal edges and opposite edges have numbered tabs 75 to identify respective successive scenes or acts, as shown particularly in FIG. 5. An uppermost, cover sheet 76 is marked along a corresponding edge with a series of zones 77 aligned over respective tabs 75 and carrying corresponding numbers to enable the position of the tabs thereunder and therefore the relevant sheets which they overlie to be identified immediately prior to starting a show.

The platform assembly or stand 4 comprises a central panel 81 formed with a pair of binding slots 85 at spaced apart locations adjacent one major longitudinal edge thereof. A pair of side panels or flaps 83 are pivotally connected to respective side edges thereof for pivotal movement from a position in which they are folded flat under the central panel to a vertical position in which they support the central panel in an elevated horizontally extending condition, forming a stage. Remote corners of the side panels are cut away at 84 for clearance purposes.

The cue sheets 86 of stack 5 have a width of approximately one half the width of the rear compartment 22 and are formed with mounting slots 87 aligned to receive respective binding rings 37. An uppermost sheet 88 is marked on both faces with zones 89 identifying all scenes and tricks with underlying cue sheets having numbered and colored tabs (not seen) corresponding to, and vertically aligned with, the tabs of the illustrated sheets 3.

The props 6 are shown in FIGS. 8*a*–8*l*, described in more detail below, and are mostly stored in a plastic bag 91, partly seen in FIG. 5, having eyes (not shown) by which it is hung from pegs 29.

Figures 3A, 3B, 3C:
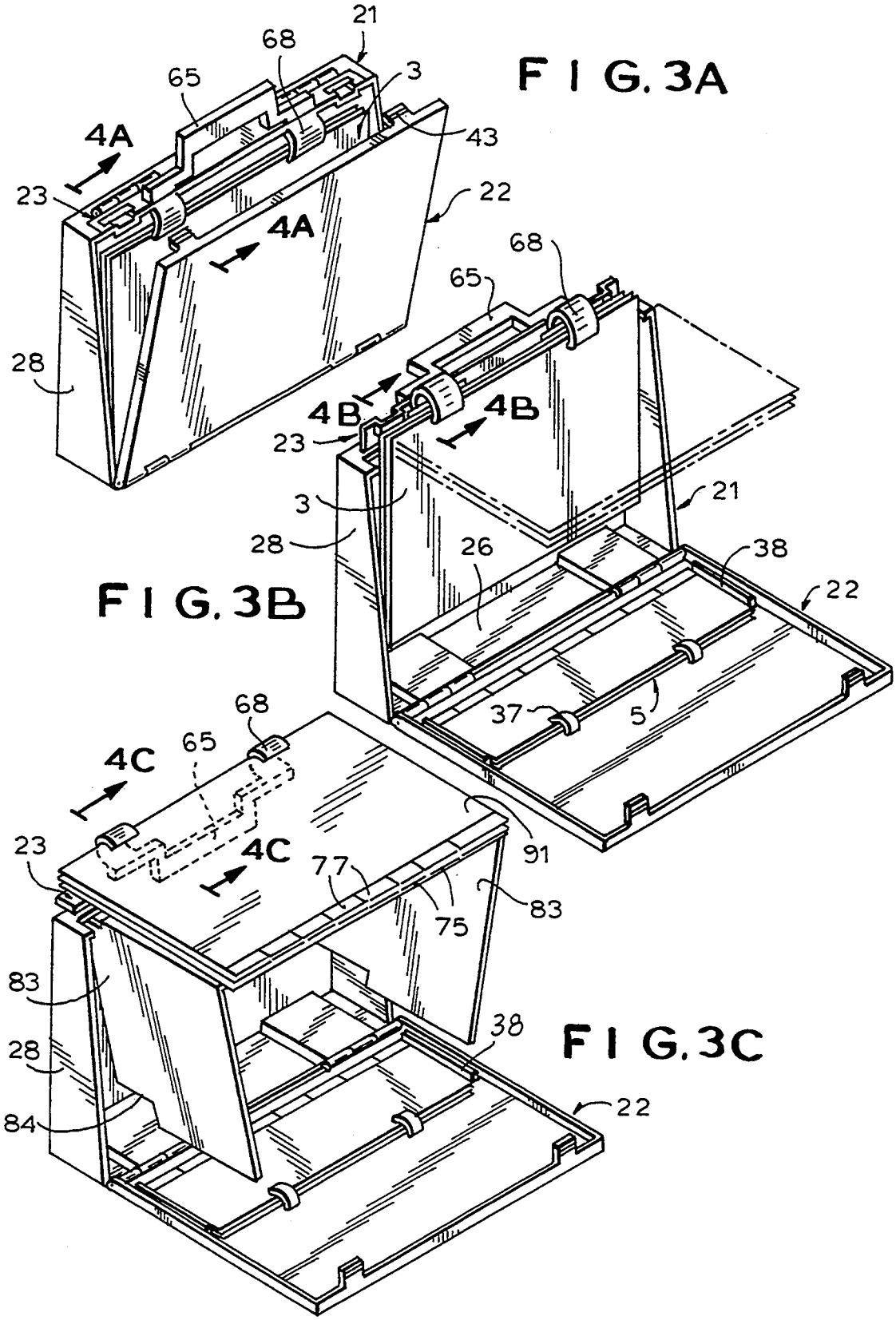
FIGS. 3A, 3B and 3C are schematic perspective views of the set at successive stages of erection.

In the assembled and closed condition of the case, shown in FIGS. 1 and 4*a*, the hinge 23 fits snugly in the cut out or rebate in the top wall 27, generally coplanar therewith, with the hinge ears 48 and 34 in pivotal connection and the latching tongues 43 inserted along respective latching channels 55 with the catches 44 in the latching recesses 57 engaging behind latching abutments 58 which fit snugly between them and the abutments 45, assuring stability. The handle mounting lugs 66 are inserted in respective apertures 61 of the hinge member 23 and the ring binder members 67 and 68 are closed together about respective axles 62 and threaded through mounting slots 74 and 82 of the stack of illustrated sheets and the panel 81 of the platform which are suspended vertically therefrom, as shown in FIGS. 3*a* and 4*a*. In this condition, the flaps 83 are folded flat under the panel 81. Most props 6 are stored in the plastic bag 91 which is suspended from pegs 39 with additional props on the base 26 of the main compartment 21. The stack 5 of cue sheets 86 are stored in a front part of compartments 22, hung from the binding rings 37.

As shown in FIGS. 3*a*–3*c*, the table top stage is erected by depression of detent latching tongues 43 to open the case by releasing the catches 44 from again the locking abutment 58 and pivoting the rear compartment rearward to lie flat on a table, as shown in FIG. 3*b*. The stack 3 of illustrated sheets is them lifted rearward and upward, slightly above the horizontal, raising the handle and hinge, with forward pivotal movement thereof, to the positions shown in FIGS. 3*b* and 4*b*, and pushed forward to rest on the top wall of the case the so that the handle pivots down to the position of FIG. 3*c* and FIG. 4*c*. It should be noted that the hinge member 23 has been rotated through 180 degrees.

The flaps 83 are then lowered and inserted at bottom ends between locating ribs 38 and the lip 36 as shown in FIG. 3*c*, the cut outs 84 providing the necessary clearance with respect to the hinge ears 39, 39' so that the central panel provides an elevated platform supporting the stack of illustrated sheets. The stack of cue sheets is turned back through 180 degrees to lie on the rear part of the rear compartment, as shown in FIGS. 5 and 6.

Individual props 102,103 and 105–110 are interleaved between appropriate illustrated sheets so as to be in place for successive tricks, as shown for example in FIG. 5. Other props are retained in the area under the platform, well concealed from the audience view but available for immediate selection when required.

The show proceeds by turning over successive illustrated sheets from the top of the stack so that they hang vertically in front of the case, suspended from the ring binder, with the newly exposed faces form successive scenes or trick elements of the matching show. At the same time, the cue sheets can be easily turned with the other hand while remaining concealed from the audience to ensure availability as prompts throughout the show both in relation to the physical execution of the trick and to provide "patter" both during the trick and introducing successive tricks, and to remind the user of the precise trick order both prior and throughout a show and to identify the appropriate pages between which the props are placed, the cut tabs facilitating handling for fluid transformation between successive tricks. The top cover sheet 88 of the cue sheets is marked on opposite faces with zones aligned both with the tabs 89 itemizing all tricks for guidance.

At the end of each trick, the used pops are returned under the platform, concealed from the audience.

An exemplary show will now be described with reference to FIGS. 8*a*–8*l*.

At the beginning of the show, the top sheet 91 is turned over through 270 degrees to hang vertically in front of the case to introduce a cast of characters A–F, illustrated on a second face thereof, who participate in various tricks throughout the show. The characters could represent family members or a cast of famous personalities. The first face of the second sheet 92, now uppermost on the stack, is blank.

Figure 8D:
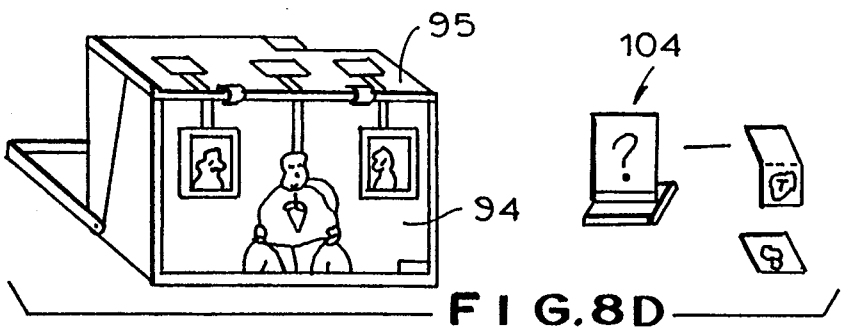
Figure 8E:
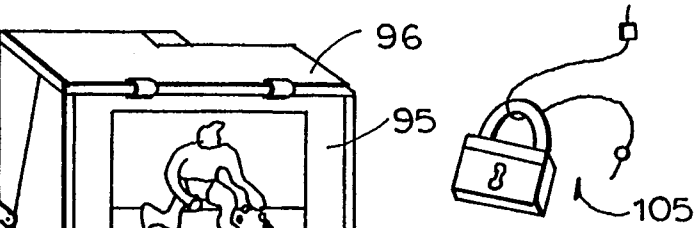
Figure 8F:
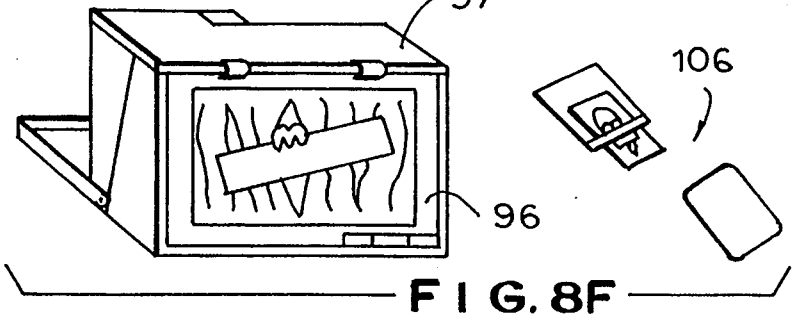
Figure 8A:
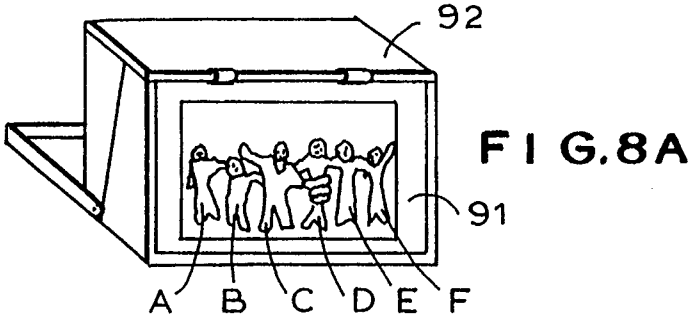
Figure 8B:
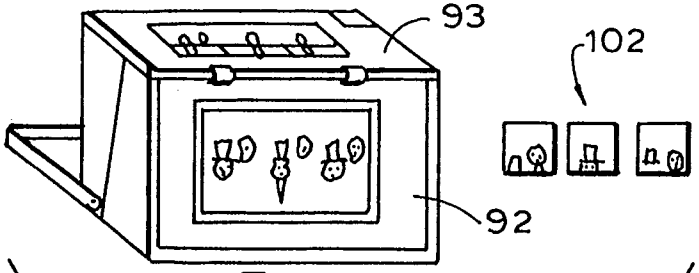
Figure 8C:
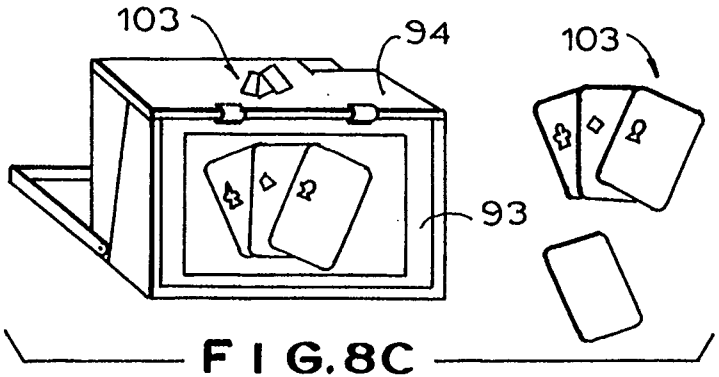
Figure 8J:
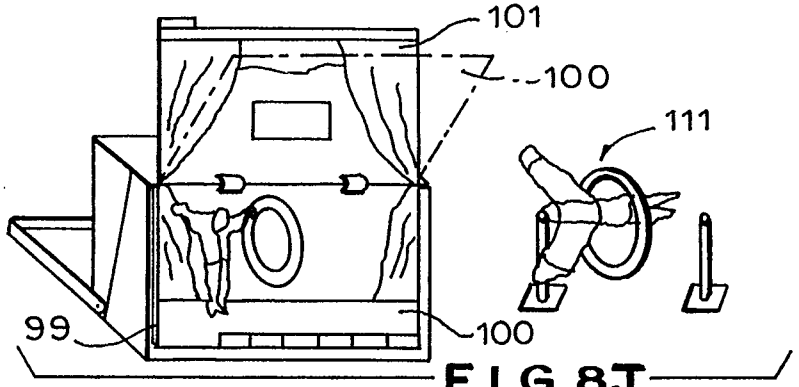

Subsequently, as shown in FIG. 8*b*, the next sheet 92 is turned over to reveal faces of the six characters marked thereon in corresponding order to those of the first sheet, while the first face of horizontal sheet 92 is marked at corresponding locations with image fragments A'–C' and E', F' representing lower portions of faces A–C And E, F behind which are three numbered squares covered by tile props 102 which have been previously prearranged thereon by the magician and, on one of their faces, carrying respective image portions which, when combined with the lower image portions, appear to an audience perusal to form the six faces A–F, completely opposite faces of the tiles are marked with numbers one to three, respectively. The magician picks up the tiles and asks a spectator to replace them "correctly" on the correspondingly numbered squares. However, this rearranges the tiles so that only five faces are seen-character D Has vanished. This is a variation of a known type of vanishing image trick described in GAMES magazine November/December 1980 and referred to in U.S. Pat. No. 5,174,570 and shown to advantage by the stage as the change in angle of audience view from a front to the top makes it completely difficult to perceived the changes in image height and combination which make the trick possible.

Sheet 93 is them turned over to reveal three cards illustrated on the second face of sheet 93 and the audience is shown, what appear to be 3 cards 103, each of which has been prepositioned between sheets 93 and 94 before the start of the show and which, in imbricating condition, match the illustrated cards. The cards are then held out face down and a member of the audience asked to remove the central card (assumed to be 3 diamonds) which when turned over is character "D" who disappeared in the previous trick. This is a variation of the known "flap card" trick.

Sheet 94 is then turned over to reveal 3 different images and prop 104 consisting of a folded card supported by a stand brought out from behind the stage. The card carries an image on a concealed side, inversable to form either of two images, while the third image is illustrated inside the fold. A member of the audience is asked to select one of the 3 characters and state which character has been selected. The magician then shows the corresponding image to the audience seemingly having sense which character has been chosen.

As shown in FIG. 8E, subsequently turning down sheet 95 reveals a "Houdini" image and prop 105 comprising a cardboard padlock and string threaded therethrough is brought from behind the stage. A member of the audience is asked to hold the of lock/ends of string and the magician quickly "escapes" by removing the lock from the string apparently by a simple tug of the string, utilizing sleight of hand.

Sheet 96 is then turn over to reveal the intermission sign as shown in FIG. 8F, and a card assembly which has been prepositioned between sheets 96 and 97 showing a fresh, untouched ice cream, is handed to a member of the audience but pulled back separating and revealing a picture of character D, already eating the ice cream.

Sheet 97 is turned down to reveal an image of character "Alexander" and props 108 including a mustache, a cube having differently colored faces and a box. A member of the audience is asked to secretly select a color and replace the cube with the chosen color uppermost therein and close the lid of the box. The magician passes the box behind his back while donning the mustache as an audience distraction while managing surreptitiously to lift the lid and peep at the cube "predicting" the color chosen with the "help" of the mustache of "Alexander".

Figure 8K:
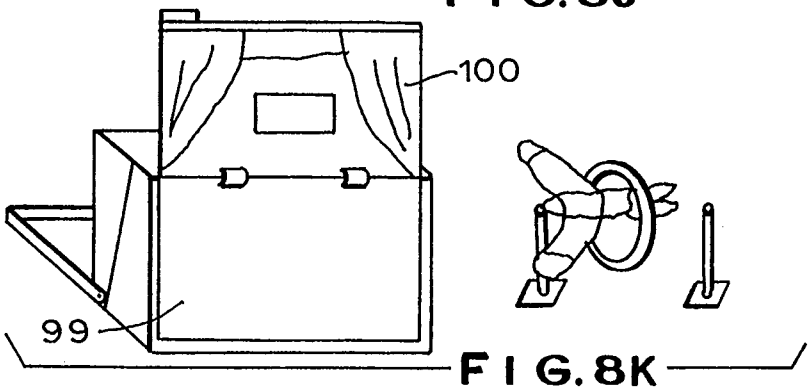
Figure 8L:
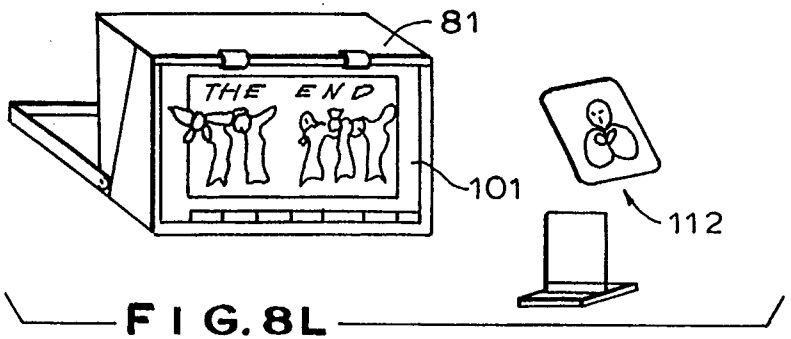
Figure 8G:
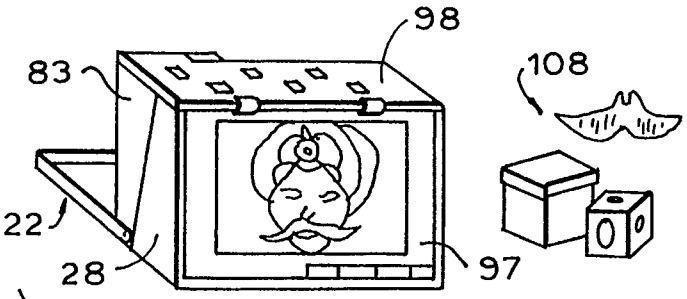
Figure 8H:
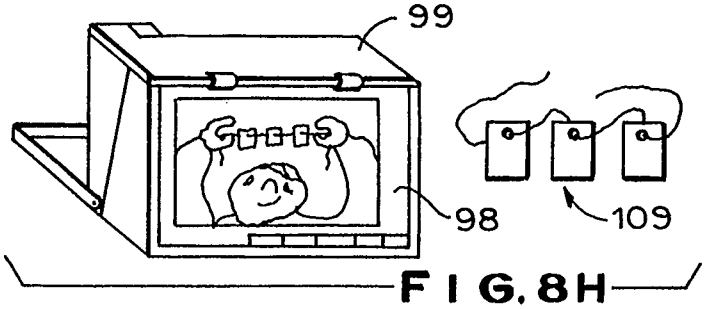
Figure 8I:
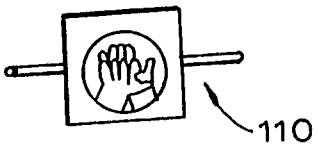

Sheet 98 is then turned over, as shown in FIG. 8H to reveal an image of another character and prop 109, prepositioned between sheets 98 and 99, consisting of string threaded through three differently colored paper tags. A member of the audience is asked to choose a color and hold the ends of the string. The magician then removes the tag of chosen color from the string without tearing it. A prop 110 consisting of a card mounted on a stick and having images of open and close hands on respective opposite faces is then twirled to provide a clapping image to elicit audience response.

The next sheet 99 is turned over together to reveal a character "Flying Ella" while the last two sheets 100 and 101 are propped up together to extend at 90 degrees above the stage to providing a dramatic effect for the finale. This is enabled by the mounting slots being oversized in relation to the binding ring thereby permitting the bound edges of the last two sheets 101 to overlap the bound edge of the lower sheet 100. The audience does not normally notice the presence of the last sheet 101, as it is hidden by sheet 100.

The props 111 comprises a cardboard torso initially placed to balance on two poles at head and feet, respectively. When the pole is removed from under the feet the torso an still balance on the other pole. A hoop can he removed from a die-cut, hook forming hand on sheet 100 and passed around the torso, demonstrating that no strings are attached. Variants of this trick are described in U.S. patent application Ser. No. 08/085284.

As shown in FIG. 8L, the attached pages 100 and 101 are then both dropped simultaneously to reveal only 5 of the six original characters taking a bow. Mischievous character D is again missing. The magician turns back only page 101 apparently looking for character D but instead of "Ella" the front of page 100 is now revealed and is blank, as shown in FIG. 8K. Character D still cannot be found.

However, prop 112 consists of two cards stood back-to-back having front faces marked with indicia illustrating "World's Best Magician" and "World's second Best Magician", respectively, and may be brought out showing the "World's Best Magician" to the audience early in the show after a successful trick and turned around to show the "World's second Best Magician" if a mistake is made in performing a trick so that a blunder becomes a joke. One of the cards has a reverse face showing character "D" and can be quickly brought out to show that character "D" has been found.

Finally, sheet 101 is also dropped to fall below the stage area showing the 5 characters as shown in FIG. 8L.

I claim:

1. A magic set comprising:

a series of props providing indicia;

a series of sheets having faces marked with indicia illustrating ones of scenes and trick elements of a magic show; wherein the indicia of the sheets are complimentary and interactive with the indicia of the series of props in forming one of a trick and story line of the show;

means supporting the sheets pivotally bound together along one of their corresponding edges as an elevated stack so that the individual, outermost sheets can be turned over successively from the stack by a magician to reveal said faces successively to an audience for performance of related tricks in conjunction with selected of the props.

2. A magic set according to claim 1 in which at least some of the sheets have both of their opposite faces marked with the indicia and the supporting means supports the stack with the sheets thereof extending horizontally so that successively outermost sheets can be turned over to extend vertically in front of an audience, indicia of faces of horizontally and vertically extending sheets so revealed, interacting to illustrate ones of scenes and trick elements of a magic show.

3. A magic set according to claim 2 in which at least some of the sheets interact to illustrate trick elements of a magic show and props are positioned between selected of the sheets which interact to form the trick elements.

4. A magic set according to claim 3 in which one face of one of the sheets which interact to form a trick element is marked with first indicia forming a trick element and props positioned on said face are marked with second indicia which interact directly with the first indicia in performance of a trick.

5. A magic set according to claim 2 in which the supporting means comprises a case including a front compartment which is open to a rear direction and comprises a top and an elongate base portion, a front panel and side panels extending between the top and a front, longitudinal edge and opposite end edges of the base, respectively, and an elongate hinge member having a front longitudinal edge portion pivotally connected to the top and carrying adjacent a rear longitudinal edge portion, binding ring means threaded through respective sheets, whereby the hinge member can be pivoted forwardly from a rear, collapsed, position in which the stack of sheets is suspended from the binding ring means stored within the front compartment, to an erect, front position in which the binding ring means extends forward beyond the front panel with the horizontally extending sheets of the stack extending rearward thereof and so that the individual sheets turned over from the stack can hang vertically from the binding ring means in front of the front panel.

6. A magic set according to claim 5 in which the supporting means includes a stand comprising a panel form platform having a front edge pivotally mounted on the binding ring means under the stack and having flap form supporting struts hingedly connected to respective opposite side edges thereof so that the stand is movable from a collapsed, vertically extending condition forward of the stack in which the flaps are fold together about the hinges in flat face to face relation against the panel to an erect condition in which the panel together with the flaps and stack is pivoted upward and the flaps are pivotally spread apart under the stack supporting the stack with the sheets extending horizontally.

7. A magic set according to claim 5 in which a carrying handle extends from the top of the case and can extend vertically downward adjacent the front panel which is inclined rearward to provide clearance therefore.

8. A magic set according to claim 5 in which a rear compartment is pivotally connected to the base for movement between an open, horizontally extending position to a closed vertically extending position covering an open rear of the front compartment latching means being provided to releasably lock the case in the closed condition.

9. A magic set comprising:

a series of props;

a series of sheets having faces marked with indicia illustrating ones of scenes and trick elements of a magic show;

means supporting the sheets pivotally bound together along one of their corresponding edges as an elevated stack so that the individual outermost sheets can be turned over successively from the stack by a magician to reveal said faces successively to an audience for performance of related tricks in conjunction with selected of the props; and, a set of instructions attached to the supporting means behind the stack whereby they are concealed from an audience's view.

10. A magic set according to claim 9 in which the set of instructions comprises a series of cue sheets having cue forming indicia on respective faces and means binding the cue sheets together along one of their corresponding edges as a stack so that the individual cue sheets can be turned over successively from the stack by a magician to expose their faces thereby revealing respective cues corresponding to successive of said one of scenes and trick elements.

11. A magic set comprising:

a case including a front compartment which is open to a rear direction and comprises a top and an elongate base wall, a front wall and side walls extending between the top and a front, longitudinal edge and opposite end edges of the base, respectively; and, a rear compartment for movement between a closed condition of the case in which the rear compartment is in a vertically extending position covering the open rear of the front compartment, and an open position allowing a magician access thereto, latching means being provided to releasably latch the rear compartment and the front compartment together in the closed condition;

a series of props for use in performing tricks;

a set of instructions for the tricks;

a series of sheets having faces marked with indicia illustrating ones of scenes and trick elements of a magic show;

binding ring means mounted at the top of the front compartment and threaded through respective sheets, whereby the set can be transformed from a collapsed, stored condition in which the case is closed by the rear compartment being latched in covering relation to the front compartment with the props, instruction set and the series of sheets contained therein, so that the sheets hang vertically as a stack from the binding ring means, to an erected condition in which the case is open with the rear compartment unlatched therefrom and in which individual outermost sheets can be turned over successively from the stack by a magician to hang in front of the front wall thereby revealing said faces successively to an audience for performance of related tricks in conjunction with selected of the props.

12. A magic set according to claim 11 in which means are provided on the case for supporting the sheets as a horizontal stack extending rearward of the binding means, in the erect condition of the set, so that the outermost sheets are uppermost in the stack.

13. A magic set according to claim 12 in which the supporting means includes a stand comprising a panel form platform having flap form supporting struts hingedly connected to respective opposite side edges thereof and a front edge pivotally mounted by the binding means, so that the stand is movable from a collapsed, vertically extending condition stored in the case forward of the stack with the flaps folded together about the hinges in flat, face to face relation against the panel, corresponding to the collapsed condition of the set, to an upstanding condition, in which the panel extends horizontally under the stack in supporting relation thereto, corresponding to the erect condition of the set, by pivotal upward movement of the panel out from the rear of the front compartment carrying with it the flaps and stack and with the flaps having been pivotally spread apart to extend vertically under the panel in supporting relation thereto.

14. A magic set according to claim 11 in which the instruction set comprises a series of cue sheets having cue forming indicia on respective faces and means on the case for binding the cue sheets together so that the individual cue sheets can be turned over successively by a magician to expose faces thereby revealing respective cues corresponding to successive of said one of scenes and trick elements while the instruction set remains attached to the case.

15. A magic set according to claim 14 in which the rear compartment is pivotally connected to the base for movement between the closed and open conditions, and extends horizontally rearward from the front compartment in the open condition, the binding means for the cue sheets comprising a ring binder provided at a medial location on an inner side of the rear compartment.

16. A magic set comprising:

a series of props providing indicia;

a series of sheets having faces marked with indicia illustrating ones of scenes and trick elements of a magic show; wherein the indicia of the sheets are complimentary and interactive with the indicia of the series of props in forming one of a trick and story line of the show;

means supporting the sheets for sequential presentation to an audience; and, indicia on successive sheets interacting directly to form one of a trick and continuous story line of the show.

17. A magic set comprising:

a series of props;

a series of sheets having faces marked with indicia illustrating ones of scenes and trick elements of a magic show;

means supporting the sheets pivotally bound together along one of their corresponding edges as an elevated stack so that the individual outermost sheets can be turned over successively from the stack by a magician to reveal said faces successively to an audience for performance of related tricks in conjunction with selected of the props; predetermined illustrated sheets having tabs which provide finger-engageable portions, outermost of the predetermined illustrated sheets overlying and thereby concealing tabs on predetermined successive sheets permitting a magician to turn over a selected number of sheets together simultaneously without detection by an audience as a function of a trick.

18. A magic set comprising:

a series of props;

a series of sheets having faces marked with indicia illustrating ones of different scenes and trick elements of a magic show;

means supporting the illustrated sheets extending horizontally as a elevated stack forming a stage, with successively uppermost leaves being removable one by one by a magician to form successive stages, thereby presenting successive ones of different scenes and trick elements to an audience;

a series of cue sheets having upper faces marked with indicia forming cues pertinent to respective ones of different scenes and trick elements on respective illustrated sheets; and, means supporting the cue sheets extending horizontally as a stack below the stack of illustrated leaves and concealed thereby from the audience with successively uppermost cue sheets being removable by the magician one by one to expose successive upper faces thereof only to the magician thereby presenting cues pertinent to respective ones of different scenes and trick elements on respective illustrated sheets simultaneously with performance of respective tricks.

19. A magic set comprising:

a series of props;

a series of sheets having faces marked with indicia illustrating ones of different scenes and trick elements of a magic show;

means supporting the illustrated sheets extending horizontally as a elevated stack forming a stage, with successively uppermost leaves being removable one by one by a magician to form successive stages, thereby presenting successive ones of different scenes and trick elements to an audience;

means on selected of the illustrated sheets defining zones on which selected props of the series of props relating to a trick element illustrated by that sheet are located.

20. A magic set comprising:

a series of props;

a series of sheets having faces marked with indicia illustrating ones of different scenes and trick elements of a magic show;

means supporting the sheets pivotally bound together along one of their corresponding edges as an elevated, horizontal stack forming a stage so that the individual outermost sheets can be turned over successively from the stack by a magician to reveal said faces successively to an audience for performance of related tricks in conjunction with selected of the props; and, means for supporting a sheet turned over from the horizontal stack upstanding vertically above the front of the stage, which upstanding sheet has indicia thereon interacting with indicia of an illustrated sheet previously turned over to hang vertically below the stack in front of the stage to form therewith a vertically extending backdrop of increased size for a trick to be performed in front thereof.

* * * * *